United States Patent [19]

Haugen

[11] Patent Number: 4,662,450

[45] Date of Patent: May 5, 1987

[54] EXPLOSIVELY SET DOWNHOLE APPARATUS

[76] Inventor: David M. Haugen, 7575 Katy Freeway #115, Houston, Tex. 77024

[21] Appl. No.: 775,613

[22] Filed: Sep. 13, 1985

[51] Int. Cl.[4] ..... E21B 23/04

[52] U.S. Cl. ..... 166/299; 166/63; 166/382; 166/387; 166/181

[58] Field of Search ..... 166/63, 277, 299, 382, 166/387, 181, 179

[56] References Cited

U.S. PATENT DOCUMENTS

| | | | |
|---|---|---|---|
| 3,113,188 | 12/1963 | Hanes | 166/63 |
| 3,167,122 | 1/1965 | Lang | 166/63 |
| 3,746,091 | 7/1973 | Owen et al. | 166/63 |
| 3,872,925 | 3/1975 | Owen et al. | 166/63 |
| 4,429,741 | 2/1984 | Hyland | 166/63 |

*Primary Examiner*—Stephen J. Novosad
*Assistant Examiner*—William P. Neuder
*Attorney, Agent, or Firm*—Marcus L. Bates

[57] ABSTRACT

The fixation of a packer or other borehole device is provided by explosively bonding the device to the borehole casing in the desired location. The explosively set packer is oriented in the borehole casing on a setting tool which preferably includes a casing scraper to clean the interior surface of the borehole casing, a removable packer to trap a gas pocket in the area where the explosive bonding is to occur and a gas transfer apparatus to form a gas pocket below the removable packer after the removable packer has been set.

20 Claims, 9 Drawing Figures

81
82
80
83
81
84
91
94
90
86
92
94
G
94
87
93
94
88
81
1D
T
70
72
C
74
191
66
14
1D
69
68
67
69
68a
69
52
66
64
89
62
57
56
X
60
54
55
52
50
14
C
13
46
40
44
42
S
46
44
40
C
42
14
22
23
F
26
24
27
18
12
17
10a
19
11
20
10
16
32
35
P
R
34a
34c
36
31
35a
30
34

C
14
81
80
91
94
90
86
82
83
87
93
99
88
T
191
70
72
68
89
52
68a
66
64
62
X
56
60
54
55
13
46
44
40
42
22
26
24
12
10
35
R
34
34c
36
31
35a
30

EXPLOSIVELY SET DOWNHOLE APPARATUS

FIELD OF THE INVENTION

The present invention relates to the placement or setting of borehole apparatus such as packers, casing bore receptacles, bridge plugs, casing patches, and liner hangers within the casing of a well bore through the explosive bonding of such apparatus to the interior of the casing.

BACKGROUND OF THE INVENTION

In the drilling of boreholes for oil and gas wells, a well casing is typiclly placed in the borehole. The casing is typically fixed by cementing it to the formation. Cementing of the casing fixes the casing to the formation by filling the annulus between the casing and the formation. Casing cement also provides a seal between the casing and formation which prevents fluid migration along the exterior of the casing. The casing and cement are perforated to allow production of the oil or gas from the formation.

Casing packers are often employed during well completion operations as well as during production. Such packers often include provision to allow removable tubing to extend through the packer for production or completion operations. The packers provide a seal between the casing and tubing. In well workover operations or recovery enhancement operations, often materials such as steam or fracturing fluids are employed. Such materials are preferably placed within a specified zone in the formation. Typically packers or other casing sealing devices are employed to separate the casing into distinct zones to allow the materials to be pumped into the desired zone of the formation. Typically an expandable packer including radially expandable slips and a resilient packing element is placed in the desired position between the casing and a tubing string by expanding the slips and packing element to fix the packer between the casing and the tubing. As an alternative, a permanent "packer" can be constructed within the casing by placing cement within the casing in a position to seal the annular space between the casing and the injection or production tubing running inside the casing.

The seals of expandable packers are subject to deterioration and possible failure from high temperatures, high treatment pressures, high formation pressures, as well as the corrosive or caustic nature of treatment, borehole fluids or production fluid. Permanent cement packers are more resistant to high temperature and pressures than expandable resilient seal packers. However, such cement packers are often susceptible to deterioration from treatment or downhole fluids and require unique placement or setting techniques.

SUMMARY OF THE INVENTION

The present invention provides for the fixation of a packer or other borehole device by explosively bonding the device to the well casing in a desired location. Such fixation is highly resistant to high temperatures and high pressures as well as borehole fluids. The explosive bonding process results in a weld-like fixation which does not appreciably affect the physical properties of the casing as would the high temperatures encountered in conventional gas or electric arc welding. The explosive bonding of a packer to a casing does not require a setting or placement technique appreciably different from those currently employed to set known expandable seal packers. The explosive setting or placement technique further provides for the setting of packer or other downhole device in the same operation as sealing of the packer or other downhole device to the casing.

Explosive welding or bonding of metal has been practiced for more than two decades on an industrial scale. Typically, clad metal combinations are produced mainly for chemical vessel fabrication, for use in the electrochemical industry, ship building and the repair of heat exchanger tubes. Explosive welding or bonding is essentially a cold bonding process which can produce clad metals with excellent bond strength and formability in metal systems that are considered incompatible by conventional techniques.

Explosive welding or bonding is basically a solid phase bonding process in which high explosives are employed to produce a high pressure and shock wave which causes a collision between the materials to be joined. A jet of metal at the apex of the collision is created. The jet breaks and cleans the surface layers of the two components to be joined and the high pressure forces the cleaned metal surfaces into intimate contact. Since little melting is associated with the explosive bonding operation, it is believed little undesired structural changes occur in such joining processes. Further, an explosive bonding process has the ability to join pairs of metals and alloys including otherwise incompatible metals.

DESCRIPTION OF AN EXEMPLARY EMBODIMENT

Figures 1A, 1B, 1C:
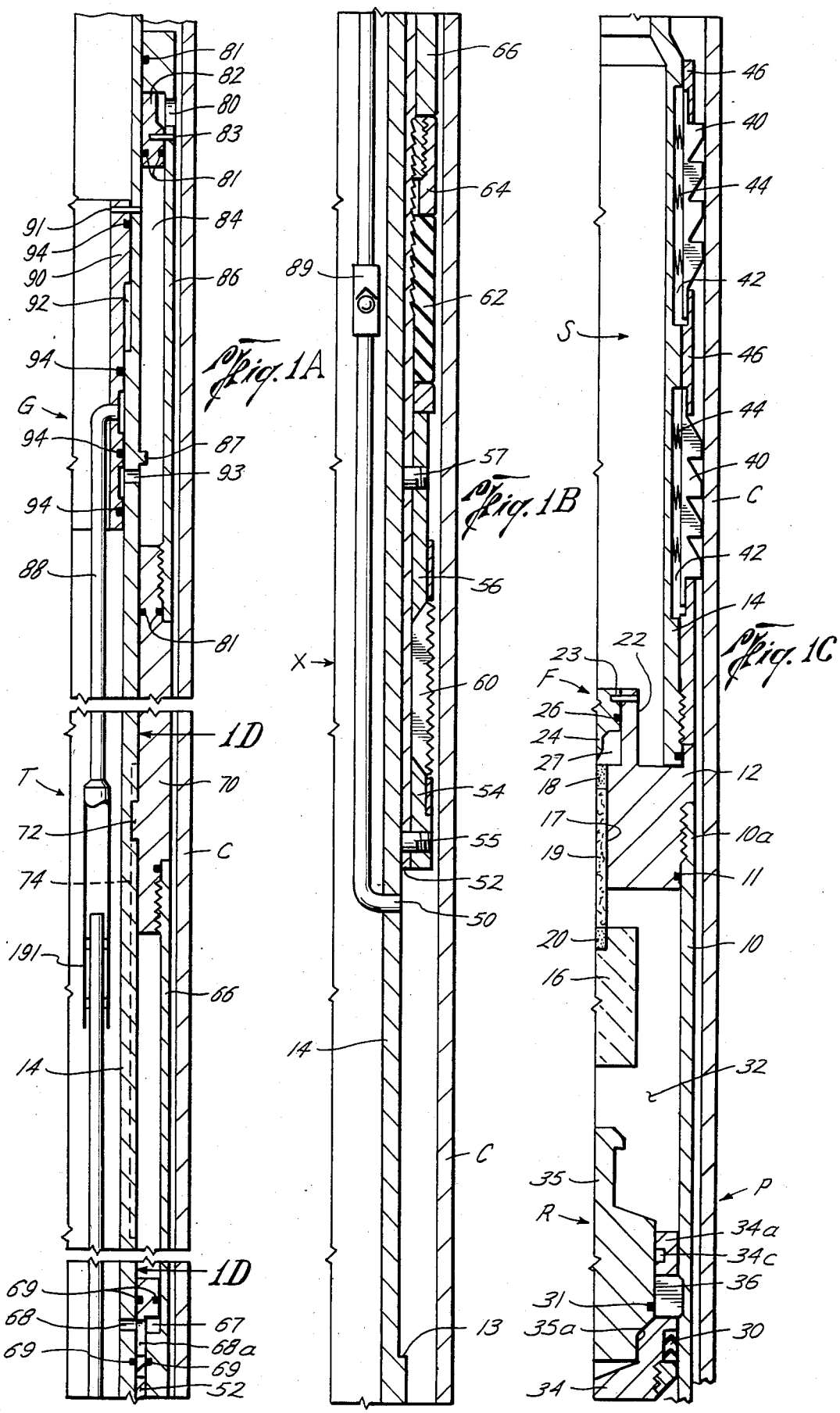
FIGS. 1A–C are segmented cross-sectional side views of the right hand half of an explosively settable packer and setting tool of the present invention, with FIG. 1A being the top segment, FIG. 1B being the middle segment, and FIG. 1C the bottom segment.

The explosively set downhole tool of the present invention is described as a packer P having a retrievable or expendable plug R located with a setting tool T which includes an auxiliary packer X, a casing scraper S, pressure activated-firing means F, and a gas pocket forming means G.

The explosive welding or bonding of metal typically requires relatively clean surfaces and preferably occurs in a gas atmosphere. For these reasons, the exemplary embodiment of the setting tool T to be used in setting packer P in the present invention includes the casing scraper S and gas pocket creating means G.

The packer P includes an annular fixation element 10 of an outer diameter slightly smaller than the casing inner diameter such that it can be lowered into the casing. The fixation element 10 is threadedly attached at its upper end 10*a* to a base plug 12 of the setting tool T. Fixation element 10 is shown as having a smooth outer surface. As an alternative, fixation element 10 could include circumferential projections (not shown) as aids to fixation. Base plug 12 is attached to setting tool body 14, with the scraper S and packer X positioned therebetween, as more fully described below. Base plug 12 serves as an upper seal to maintain an air chamber 32 and as an upper containment for the setting pressure created by the detonation of the explosive charge 16 (FIG. 1C) more fully described below.

Base plug 12 is a relatively heavy cylindrical plug which includes a central bore 17 for receiving explosive initiator 18, usually lead azide and a booster cap or a deflagration detonation device, and primer cord 19. Extending upward from base plug 12 is a pressure activated firing means comprising a support ring 22 and firing pin 24. Firing pin 24 is retained in support ring 22 by a shear pin 23. Upon application of a predetermined fluid pressure within setting tool body 14, shear pin 23 is sheared and firing pin 24 is driven downwardly through atmospheric air pressure chamber 27. Firing pin 24 detonates initiator 18 to detonate primer cord 19, and booster cap 20, which detonates the explosive charge 16. A suitable seal such as O-ring 26 is provided between firing pin 24 and support ring 22 so that an atmospheric pocket 27 is created to prevent contamination of initiator 18, primer cord 29, booster cap 20 or explosive charge 16 by fluids within the casing. Atmospheric air pressure chamber 27 also provides the necessary pressure differential across firing pin 24 to shear shear pin 23 when pressure within setting tool body 14 is increased to a predetermine level above hydrostatic pressure.

Fixation element 10 extends from threaded attachment to base plug 12 which includes a suitable O-ring 11 downward to a retrievable plug R. Retrievable plug R includes a seal means 30 adjacent lower portion of dogs 34 which provides for containment of an atmospheric air chamber 32 around explosive charge 16. Retrievable plug R includes a fishing neck 35 and dogs 34 with releasable slip ring locks 36 such that retrievable plug R will resist an upward movement so as to resist upward hydrostatic pressure and to provide a lower seal for air chamber 32 yet can be removed by an upward pull on fishing neck 33 in a manner as would be well known in the art. As an alternative retrievable plug R could be loosely attached to base 12 such as by a cable (not shown) whereby retrievable plug R would be removed in the same operation as retrieving setting tool T, more fully described below.

Retrievable plug R includes a split snap ring 31 adjacent ring locks 36. When retrievable plug R is pulled upward, snap ring 31 expands into groove **34*c* in the upper portion 34*a* of dogs 34. Ring locks 36 then move into the reduced diameter portion 35*a* of plug body 35 as retrievable plug R is pulled upward, releasing dogs 34 from engagement with fixation element 10**.

Upon detonation of explosive charge 16, the radial shock wave created drives fixation element 10 radially outwardly (FIG. 3C) into the casing C creating an explosive weld or bond therebetween. Explosive charge 16 is shaped in a manner as would be well known in the art so as to provide a substantially radial shock wave. The explosive expansion of fixation element 10 further releases the threaded attachment to base plug 12 (FIG. 3C) allowing removal of setting tool T from element 10 so as to leave element 10 in the casing C when the tool T is pulled upwardly out of the casing C. Fixation element 10 is described as a hanger for a retrievable plug R. However, fixation element 10 can include another bore hole tool (not shown) oriented below retrievable plug R or retrievable plug R can be replaced with any other bore hole tool oriented by attachment to fixation element 10.

As an alternative to explosive welding or bonding of fixation element 10 directly to casing C, the explosive radial expansion of fixation element 10 may be employed to provide the high energy rate compaction of powdered material. A preform of partially compressed powder, either metal or polymer, could be located between fixation element 10 and casing C. Upon the explosive radial expansion of fixation element 10, the powder material would become compacted into a rigid fixation means between element 10 and the casing C.

In explosive welding or bonding, a clean surface, and a gas atmosphere are preferable. Setting tool T includes an integral casing scraper S to allow the cleaning of the interior surface of casing C prior to the explosive setting of packer P. Casing scraper S comprises cutter blades 40 oriented in longitudinally extending circumferential recesses 42 in setting tool body 14. The cutter blades 40 are biased radially outwardly by springs 44 and are retained by retention collars 46. If the casing is relatively new or a separate casing cleaning operation is to be employed, casing scraper S may be deleted from setting tool T. The action of the cutter blades 40 of casing scraper S further provides for centering of the device in the casing. If a separate casing scraper is to be employed, a centralizing tool (not shown) may be employed in order that fixation element be centered in the casing.

Oriented above casing scraper S on setting tool body 14 is an auxiliary packer X. Auxiliary packer X is set in the casing C above the desired location of fixation element 10 to contain a gas pocket in the annular region between the casing C and setting tool body 14. The gas pocket provides a gaseous atmosphere between fixation element 10 and casing C where the explosive welding or bonding is to occur.

Figure 2A:
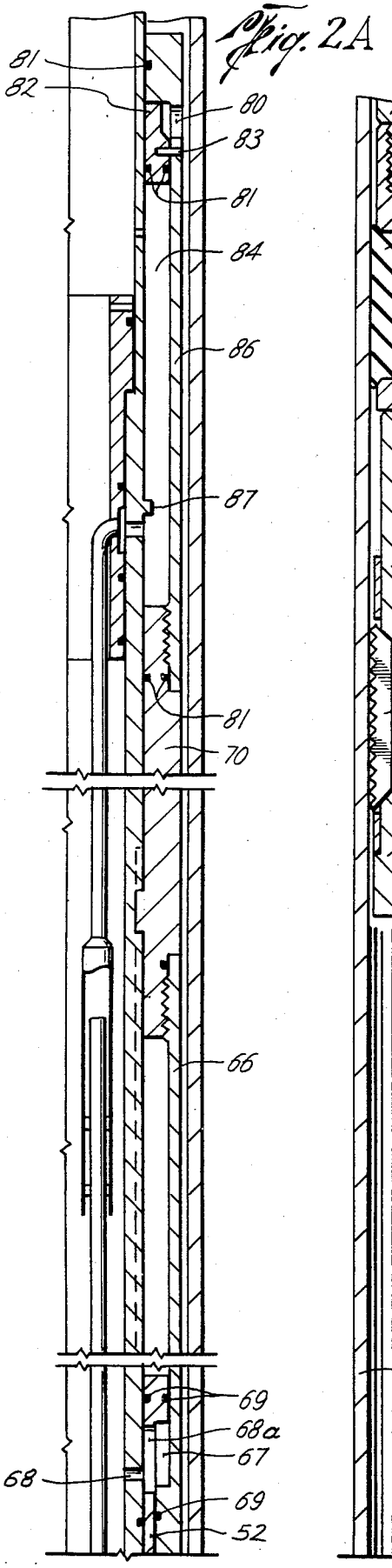
FIGS. 2A–B are segmented cross-sectional views of the right hand of an explosively settable packer and setting tool of the present invention, with FIG. 2A being the top segment, and FIG. 2B the middle segment.
Figure 2B:
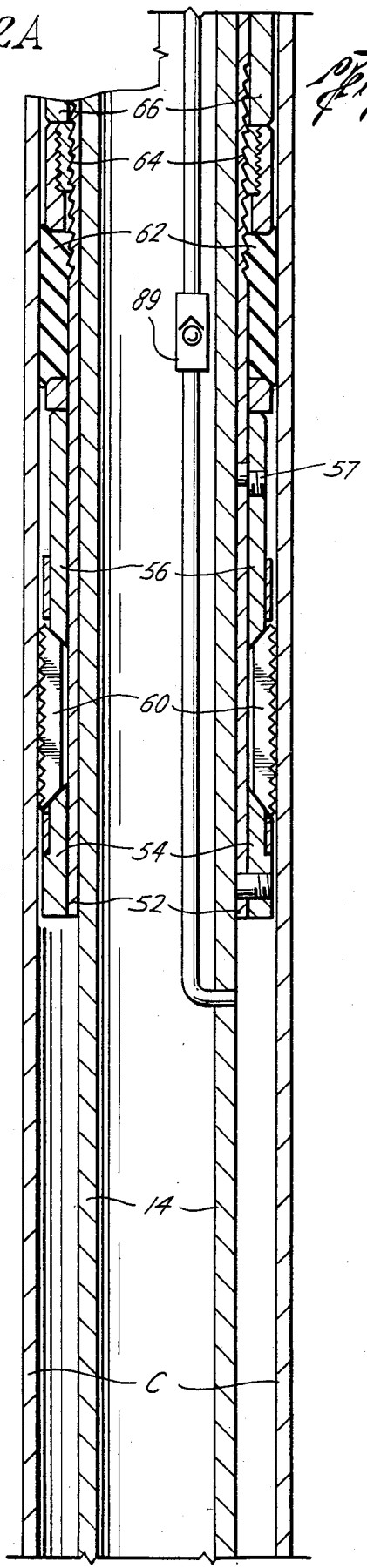

Auxiliary packer X is oriented on setting tool body 14 above gas injection port 50 (FIG. 1B). Auxiliary packer X is a pressure activated retrievable packer which is set by fluid or gas pressure within the interior of setting tool body 14. Oriented circumferentially around setting tool body 14 is auxiliary packer support 52. Support 52 has a lower wedge 54 mounted on lower end thereof with a shear screw 55 (FIG. 1B). An upper wedge 56 is mounted on support 52 by a shear screw 57. Oriented around support 52 between upper wedge 56 and lower wedge 54 are packer slips 60. The shear screws 57 and 54 hold upper wedge 56 and lower wedge 55 in a release position (FIG. 1B). The strength of shear screw 57 is less than that of shear screw 55 as will be more fully described below. Auxiliary packer X further includes a polymeric packing element 62 positioned around support 52 above upper wedge 56 retained by a ratcheting lock ring 64. Ratcheting lock ring 64 is activated by setting element 66 to compress polymeric packing element 62. Extending through setting tool body 14 is an injection port 68 and extending through the upper end of support 52 into setting chamber 67 is an injection slot **68*a* (FIG. 1A). Injection port 68 and injection slot 68*a* provides access to setting chamber 67 which is defined by suitable O-rings 69. Upon the pressurization of the interior of setting tool body 14 and setting chamber 67 through port 68 and slot 68*a* to a predetermine pressure, support 52 is forced upwardly. The action of setting element 66 upon rubber packing element 62 and upper wedge 56 as support 52 is forced upwardly shears shear pin 57 driving upper wedge 56 downwardly, forcing the slips 60 outwardly into contact with the casing C. Further pressure forces ratcheting lock ring 64 downwardly. The downward action of lock ring 64 deforms rubber packing element 62 which expands radially to contact casing C (FIG. 2B). The ratcheting action of ratchet lock ring 64 maintains auxiliary packer X in a set position. The lower shear pin 55 allows the release of auxiliary packer after explosive packer P has been set by pulling upward on setting tool body 14. Setting tool body 14 includes a shoulder 13 to contact support 52. An upward pull on setting tool body 14 will force shoulder 13 into contact with support 52 and further pulling will shear shear pin 55 which allows lower wedge 54 to drop releasing slips 60 and rubber packing element 62**.

Figure 1D:
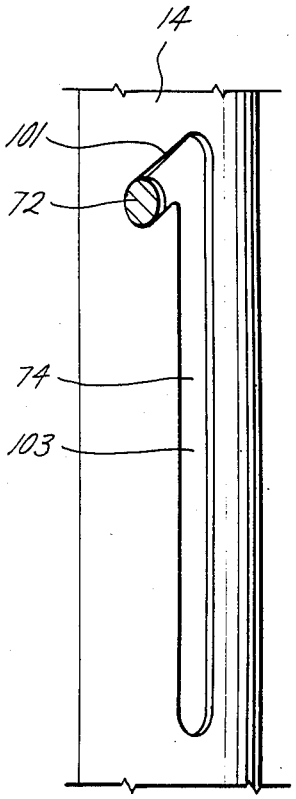
FIG. 1D is a view along line D—D of FIG. 1A.

Setting element 66 extends upward from the auxiliary packer X in the annulus between setting tool body 14 and casing C to a pin ring 70. Pin ring 70 is an annular ring about setting tool body 14 which includes a pin 72 extending into a "J" slot 74 on setting tool body 14 (FIG. 1D). When the pin 72 is in the foot 101 of the "J" slot auxiliary packer X is supported above scraper tool S with injection port 68 aligned with injection slot 68*a*. After auxiliary packer X is set, setting tool body 14 is raised and rotated to move pin 72 into the leg 103 of "J" slot. With the pin 72 in the leg of the "J" slot, setting tool body 14 can be raised and lowered to provide the action necessary for scraper tool S to clean the interior of the casing.

After scraper tool S has cleaned the interior of the casing, setting tool body 14 is raised to orient fixation element 10 within the casing adjacent the cleaned area. Fluid pressure is applied to the annulus between the tool T and casing C. Pressurized fluid enters port 80 shears shear pin 83 and drives piston 82 downwardly through gas chamber 84. Gas chamber 84 is created by upper annular container 86 which extends from a pin ring 70 upwardly and concentrically with setting tool body 14 (FIG. 2A). Piston 82 is held in place by shear pin 83 which releases when the annular pressure exceeds a predetermined amount. Gas chamber 84 is maintained by suitable O-rings 81 between annular container 86, setting tool body 14, and piston 82.

The movement of piston 82 downwardly in gas chamber 86 forces the gas therein through transfer tube 88, through a check valve 89 and through port 50 to create a gas pocket below the auxiliary packer X in the area where the explosive packer P is to be set. Transfer tube 88 extends from piston 90 to port 50 and includes expansion joint 91. Piston 90 retained on tool body 14 by shear pin 91 includes an atmospheric air pressure chamber 92 maintained by O-rings 94 between piston 90 and setting tool body 14. As the pressure within setting tool body 14 is increased, the pressure differential between the interior of body 14 and air chamber 92 will force piston 90 downward shearing shear pin 91 so that transfer tube 88 will align with opening 93 in tool body 14 to allow the transfer of gas through transfer tube 88. The formation of a gas pocket below auxiliary packer X allows for the explosive welding of the fixation element 10 to occur in a gas atmosphere. As an alternative to the transfer of gas from a chamber, a chemical reaction could be employed to create the desirable gas pocket below auxiliary packer X.

In practice, the apparatus of the present invention is run into a well casing on a pipe string (not shown). Upon orientation in the zone where the permanent packer P is desired, pressure is applied within the setting tool body 14. The fluid pressure within the setting tool body 14 drives support 52 of the auxiliary packer X upwardly concentric with setting tool body 14 shearing shear pin 57. The movement of support 52 upwardly wedges slips 60 radially outwardly into the casing C and deforms rubber packing element 62 so as to set auxiliary packer X. The one-way ratcheting action of ratchet ring assembly 64 locks auxiliary packer X in the set position (FIG. 2B).

The setting tool body 14 is then raised slightly and rotated to move pin 72 from the foot 101 of the "J" slot into the leg 103 of the "J" slot (FIG. 2B). This allows the setting tool body 14 to be reciprocated to provide the action necessary for casing scraper S to clean the interior surface of the casing C. Thereafter setting tool body 14 is raised so that explosive packer P is oriented in the "clean" area of the casing C which will place shoulder 13 near to or in contact with auxiliary packer support 52 (FIG. 3B).

Figures 3A, 3B, 3C:
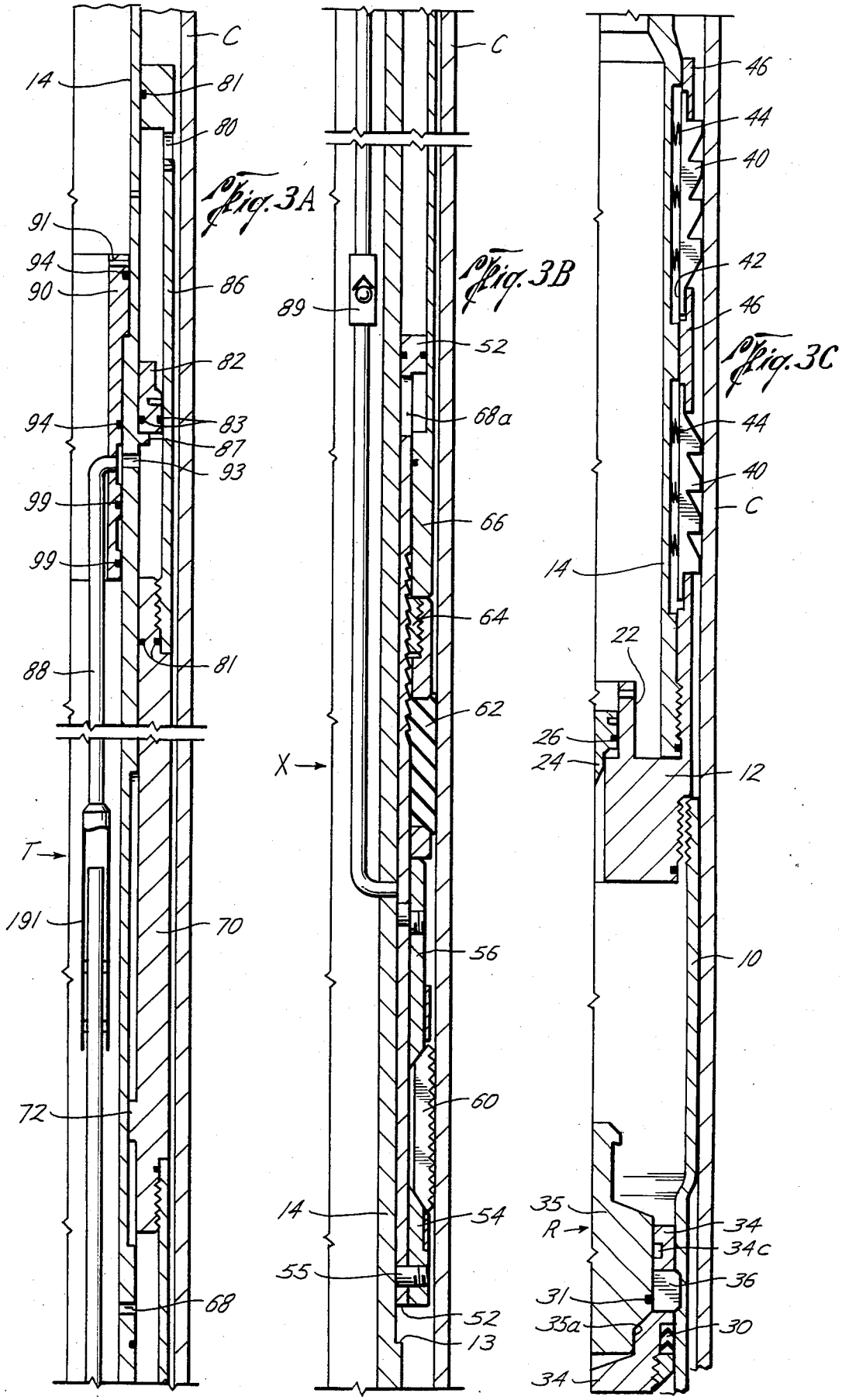
FIGS. 3A–C are segmented cross-sectional side views of an explosively set packer and setting tool of the present invention, with FIG. 3A being the top segment, FIG. 3B being the middle segment, and FIG. 3C being the bottom segment.

Fluid pressure within tool body 14 is raised by pump pressure applied at the surface to shear shear pin 91 and is maintained at a level to force piston 90 downwardly to align opening 93 in body 14 with the upper open end transfer tube 88 (FIG. 3A). Annular fluid pressure is then applied between casing C and support body 14 which shears shear pin 83 and forces piston 82 downwardly, driving the gas within gas chamber 84 through transfer tube 88 and check valve 89 through port 50 to create a gas pocket below auxiliary packer X. In addition to creating a gas pocket below auxiliary packer X, the gas in creating a gas pocket and driving fluid out of the area washes away the debris created by the action of scraper S.

When piston 82 has bottomed against shoulder 87 (as indicated by a sharp increase in the annular pressure), annular pressure is maintained while the pressure within the interior of setting tool body 14 is again increased by pump pressure applied at the surface to the point where shear pin 23 fails, releasing firing pin 24, and activating the explosive charge 16. The explosion of explosive charge 16 drives fixation element 10 radially outwardly welding or bonding it to the casing C. The explosive expansion releases the threaded attachment between lower plug 12 and fixation element 10 which allows the removal of setting tool T (FIG. 3C). Pulling on setting tool body 14 will release auxiliary packer X by shearing shear pin 55 which allows lower wedge 54 to fall into contact with scraper tool S. Setting tool T can then be removed to be reused after the shear pins 23, 55 and 57 are replaced.

Thus a packer is set in a casing by explosive welding or bonding such that it is highly resistant to heat or fluid pressures yet the explosive welding does not materially affect the strength of the casing C.

It should be understood that the foregoing description and drawings of the invention are not intended to be limiting, but are only exemplary of the inventive features which are defined by the claims.

What is claimed is:

1. A method of fixing a downhole device within a well casing which comprises the steps of:

positioning a fixation element on a support assembly;

lowering said fixation element and support assembly into a well casing;

arranging an explosive within said fixation element;

arranging said explosive and fixation element respective to the casing such that when the explosive is detonated, the fixation element is explosively welded directly to the casing;

detonating said explosive to thereby explosively bond said fixation element to said well casing;

removing said support assembly from said well casing.

2. The method of claim 1 wherein the interior surface of said well casing in the area said fixation element is to be bonded is cleaned prior to bonding of said element therein.

3. The method of claim 1 wherein a casing scraper is attached to said support assembly and said interior surface is cleaned by reciprocation of said support assembly.

4. The method of claim 1 and further including the step of using a packer for supporting the support assembly within the casing; and carrying out the step of detonating the explosive charge by elevating the borehole pressure at a location above said packer.

5. The method of claim 1 and further comprising the step of forming a gas pocket within the borehole and in the area where said fixation element is to be bonded to the well casing.

6. The method of claim 1 wherein said fixation element is explosively bonded to said well casing by the explosive sintering of a metal powder material oriented between said fixation element and said well casing, such that metal to metal contact is achieved between the fixation element and said well casing.

7. A method of permanently fixing a downhole device directly to the interior of a well casing which comprises the steps of:

placing a removable packer within the well casing adjacent the location where the device is to be fixed;

using the packer to form a gas pocket in the location where the device is to be fixed to the casing wall;

arranging an explosive within said device such that when the explosive is detonated, the device is permanently expanded into metal to metal contact within the casing through the explosive bonding of the device to the interior surface of the well casing.

8. The method of claim 7 wherein the interior surface of said well casing in the area where said device is to be fixed is cleaned prior to setting of the device therein; and, an incompressible fluid is contained between the casing and the device during the step of explosive bonding the device to the casing.

9. The method of claim 7 wherein said interior surface is cleaned hydraulically.

10. The method of claim 7 wherein said interior surface is cleaned by a casing scraper oriented between said removable packer and said device activated by reciprocation of said casing scraper.

11. The method of claim 7 wherein said device is fixed within said well casing by the explosive sintering of a powdered material oriented between said device and said well casing.

12. The method of claim 11 wherein said powdered material is metallic powder oriented between said device and said well casing, such that the device, powdered material, and casing are made integral respective to one another by said explosive bonding.

13. An explosively fixable downhole device for permanent fixation within a well casing which comprises:

a removable packer comprising expandable slips, a setting apparatus, an expandable sealing means oriented on said packer;

means by which a gas pocket can be formed at a location below said removable packer; and, an explosively fixable element oriented below said removable packer and within said gas pocket comprising a deformable outer shell and means to explosively fix said outer shell directly to the well casing.

14. The device of claim 13 and further including means supported on said setting apparatus for cleaning the interior surface of the well casing, said means on said setting apparatus being interposed between said packer and said deformable outer shell.

15. The device of claim 14 wherein the means for cleaning the casing comprises hydraulic cleaning means.

16. The device of claim 13 wherein said fixable element is an outer shell which supports a permanent packer, said explosively fixable element includes means responsive to uphole pressure by which said outer shell is explosively welded to the interior of the casing.

17. The device of claim 13 wherein means are provided by which said interior surface of the casing is cleaned by reciprocation of said device.

18. The device of claim 13 and further including a preform of powdered material oriented between the outer shell and the well casing whereby said outer shell is fixed to said well casing by sintering of said preform upon explosive deformation of said outer shell.

19. The device of claim 18 wherein said powdered material is metallic powder.

20. The device of claim 13 wherein said means to deformably fix said deformable outer shell includes a shaped explosive charge supported on the interior of said shell; means responsive to uphole pressure in the wellbore for detonating said explosive charge; and, means for removing the removable packer and setting apparatus after said deformable outer shell has been permanently fixed to the casing wall.

* * * * *

UNITED STATES PATENT AND TRADEMARK OFFICE

CERTIFICATE OF CORRECTION

PATENT NO. : 4,662,450

DATED : MAY 5, 1987

INVENTOR(S) : DAVID M. HAUGEN

It is certified that error appears in the above-identified patent and that said Letters Patent is hereby corrected as shown below:

Column 2, line 38, insert --side-- before "views";

Column 7, line 11, insert --where-- after "area".

Signed and Sealed this

First Day of September, 1987

*Attest:*

*Attesting Officer*

DONALD J. QUIGG

*Commissioner of Patents and Trademarks*